United States Patent [19]

Freshwater et al.

[11] 4,429,940

[45] Feb. 7, 1984

[54] TAP CONNECTOR

[75] Inventors: Lane A. Freshwater, Lino Lakes; Eugene E. Moynagh, Afton, both of Minn.

[73] Assignee: Minnesota Mining and Manufacturing Company, Saint Paul, Minn.

[21] Appl. No.: 325,348

[22] Filed: Nov. 27, 1981

[51] Int. Cl.[3] ..... H01R 9/09

[52] U.S. Cl. ..... 339/99 R; 339/176 MF

[58] Field of Search ..... 339/99 R, 98, 97 R, 339/97 P, 176 MF, 17 F

[56] References Cited

U.S. PATENT DOCUMENTS 3,930,708 1/1976 Wedekind et al. ..... 339/99 R 4,258,974 3/1981 Kuo et al. ..... 339/97 R 4,364,622 12/1982 Huntley ..... 339/97 R

*Primary Examiner*—John McQuade

*Assistant Examiner*—Paula Austin

*Attorney, Agent, or Firm*—Donald M. Sell; James A. Smith; Terryl K. Qualey

[57] ABSTRACT

A tap connector for tapping branch conductors to conductors of a bus cable has an insulating base, a plurality of tap contacts retained in the base and an insulating cover. Each contact is a flat metal plate having three parallel, closely spaced legs extending from one edge. The two outer legs lie in a common plane and the center leg lies in a plane parallel to the common plane and is offset therefrom creating conductor connection slots between the center leg and each of the outer legs for a conductor of a bus cable and a tapping branch conductor at an angle to the bus conductor.

11 Claims, 6 Drawing Figures

TAP CONNECTOR

FIELD OF THE INVENTION

The present invention relates to a tap connector for tapping branch conductors to conductors of a bus cable.

BACKGROUND OF THE INVENTION

Multiple conductor flat electrical cables are in wide spread usage in the electronics industry for signal and power distribution, for example in computers. Connectors for making electrical connection to the individual conductors of multiple conductor flat cables have long been in use and have included connectors utilizing contact elements that comprise flat metal plates having three parallel, closely spaced legs as disclosed in U.S. Pat. Nos. 3,816,818; 3,930,708 and 4,062,615.

Frequently it is necessary to distribute power or signals to a number of points. In such cases it is desirable to continue the main cable, commonly known as the bus cable, while tapping off of some or all of the conductors of the cable for each location the power or signal is required. The individual wires or flat cable tapped into the bus cable is called a branch cable. It is preferable that the bus conductors and branch conductors intersect at 90° so that the branch conductors can be run off to electrical circuitry to the side of the bus cable. Connectors for making such connections are disclosed in U.S. Pat. Nos. 4,258,974 and 4,364,622.

SUMMARY OF THE INVENTION

The present invention provides a tap connector for tapping branch conductors to conductors of a bus cable comprising an insulating base, a plurality of tap contacts retained in the base and an insulating cover. Each contact comprises a flat metal plate having three parallel, closely spaced legs extending from one edge, the two outer legs lying in a common plane and the center leg lying in a plane parallel to the common plane and offset therefrom by a distance at least equal to the thickness of the plate. The outer legs of each contact are spaced from the center leg to create two parallel sided conductor connecting slots of lesser width than the conductors to be connected for electrically connecting a branch conductor in one slot to a conductor of a bus cable in the other slot. The contacts are positioned in the insulating base to connect a plurality of parallel equally spaced conductors of a bus cable to a plurality of parallel equally spaced branch conductors at an angle to the conductors of the bus cable. The insulating cover has receptacles for the ends of the tap contacts to permit the cover to force the bus and branch conductors into the conductor connecting slots in the contacts when the cover is placed over the base and they are pressed together.

THE DRAWING

DESCRIPTION OF THE PREFERRED EMBODIMENT

Figure 1:
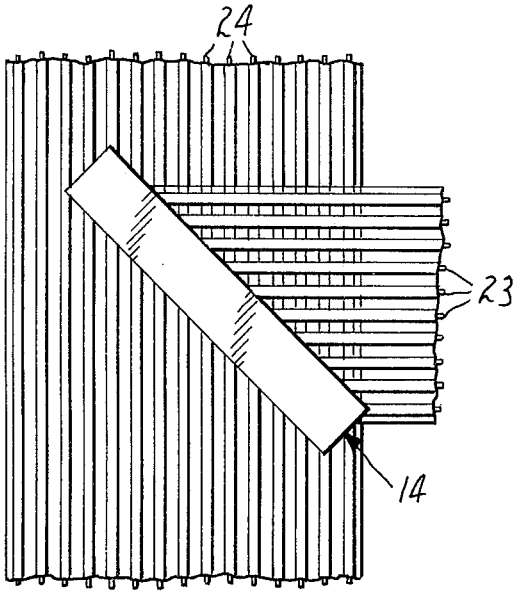
FIG. 1 is a top view of a tap connection made utilizing a connector constructed in accordance with the present invention.
Figure 2:
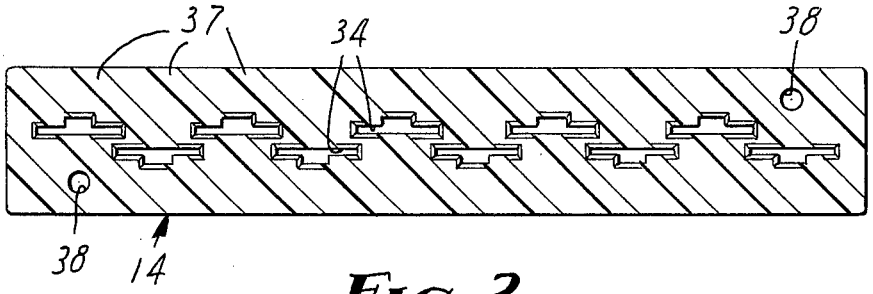
FIG. 2 is a bottom view of the insulating cover of the connector of the present invention.
Figure 3:
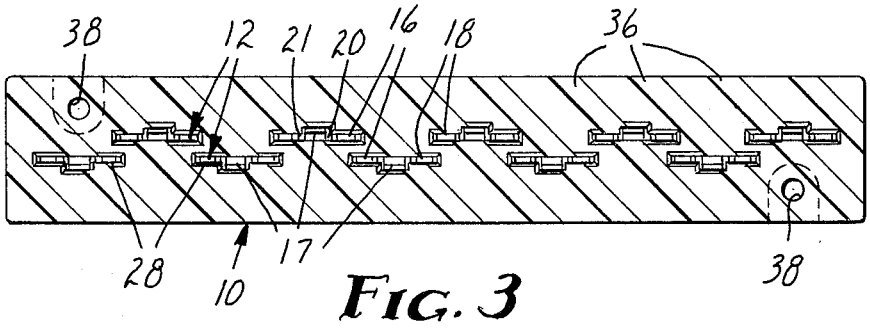
FIG. 3 is a top view of the insulating base with the contact elements therein.

The tap connector of the present invention has an insulating base 10, a plurality of flat metal plate contact elements 12 and an insulating cover 14. In the preferred embodiment the base 10 and cover 14 are rectangular and may be molded of any rigid insulating plastic, and there are two rows of contact elements 12 retained in the base 10 with their faces parallel to the longitudinal edges of the base, all of which contribute to a very compact design.

Each contact 12 has three parallel, closely spaced legs 16, 17 and 18 extending from one edge. The outer two legs 16 and 18 lie in a common plane and the center leg 17 lies in a plane parallel to the common plane of the outer legs and is offset therefrom by a distance at least equal to the thickness of the plate. The outer legs 16 and 18 are spaced from the center leg 17 to create two parallel sided conductor connecting slots 20 and 21 of lesser width than the conductors to be connected for electrically connecting a branch conductor 23 to a conductor 24 of a bus cable. The offset of the center leg 17 in the preferred embodiment creates wire paths through the slots 20 and 21 that are at 90° angle to each other. However, other angles which direct the branch cable away from the bus cable may also be used by adjusting the center leg offset and the slot width prior to offsetting of the center leg from the plane of the outer legs. In the drawings the branch cable as well as the bus cable is a multi-conductor flat cable, but either or both could consist of individual insulated wires. The illustrated cable consists of individually insulated, color coded, wires in a transparent plastic web, the conductors being 22 American Wire Gauge stranded and being spaced on 3.96 mm (0.156 in.) centers. This cable is commonly used for power distribution to electronic circuitry.

Each contact is formed with wedge shaped projections along the outer edge of the outside legs 16 and 18 progressing outward from the base of the contact to define sharp latching corners 26. The insulating base 10 is formed with pockets 28 complementary to the cross sectional shape of the contacts and of a width generally equal to the width of the contact 12 without the latching wedges so that when the contacts 12 are force fit into the pockets 28 in the base 10 the latching corners 26 bite into the plastic and firmly anchor the contacts 12. Dimples 29 are also formed in the faces of the contacts 12 to take up tolerances in the contact pockets 28 to assist in rigidly mounting the contacts 12 in the base 10.

Each contact 12 has its legs 16, 17 and 18 relieved at their free ends along their edges facing the conductor connecting slots 20 and 21 to define wire retention areas 31 and 32 of a width greater than the conductors 23 and 24 to be connected to engage the insulation on the conductors and thereby retain the conductors in position prior to connecting in the slots 20 and 21. The inner edge of one of the outer legs 18 and the adjacent edge of the center leg 17 are relieved further along the conductor connecting slot a distance generally equal to the diameter of the insulated conductors to be connected. This creates one wire retention area 32 that is deeper than the other 31 by an amount generally equal to the diameter of the insulated conductors, which in the illustrated embodiment is the thickness of the multi-conductor flat cable. This permits the visual alignment of the bus cable conductors 24 with the deeper retention areas 32 and then manual pressing of the bus cable down onto the contacts to force the contact legs 16, 17 and 18 through the plastic web between the insulated conductors 24 to position the bus cable and retain it in proper position. Similarly the branch cable can then also be visually positioned with its conductors 23 aligned with the shallower retention areas 31 and manually pressed down so that the ends of the legs 16 and 17 pierce the plastic web and engage the insulation around the conductors 23 to properly position the branch cable.

Figure 4:
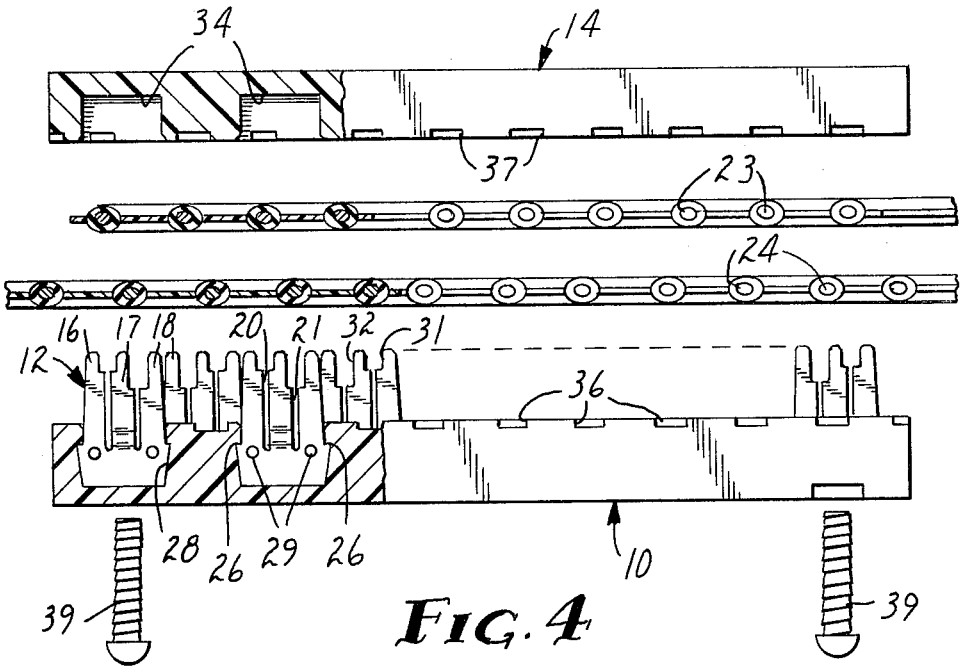
FIG. 4 is a side elevation view of the base and cover aligned with a bus cable and a branch cable in proper alignment for connection between them.
Figure 5:
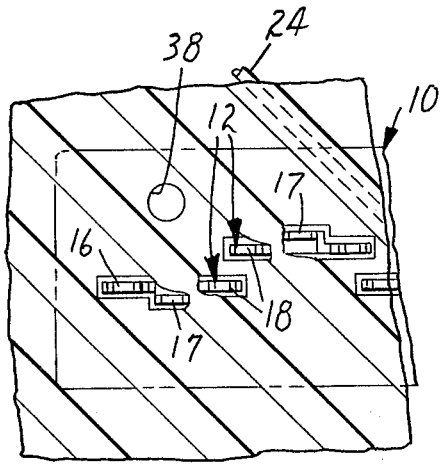
FIG. 5 is a partial top view of the base with conductors of the bus cable pressed into the wire retention areas of the contacts.
Figure 6:
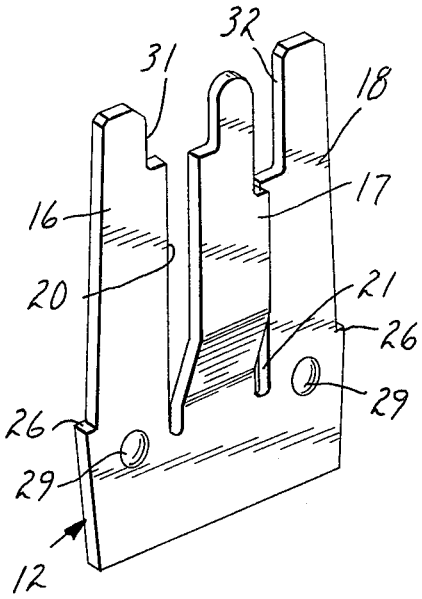
FIG. 6 is a perspective view of one of the contacts of the connector of the present invention.

The cover 14 is formed with receptacles 34 for the ends of the contact elements 12. In use, the cover is placed over the base as illustrated in FIG. 4 after the cables have been manually pressed into the wire retention areas 31 and 32. The cover and base are then pressed together to force the bus and branch conductors 24 and 23 into the conductor connecting slots 21 and 20, respectively, to electrically connect the branch conductors 23 to the bus conductors 24.

The base 10 is formed with parallel equally spaced wire alignment channels 36 extending across its width at a 45° angle to position the conductors that are to lie adjacent the base (the bus conductors 24 in the illustrated embodiment). The cover 14 is also formed with parallel, equally spaced, wire alignment channels 37 extending across its width at a 45° angle to position the conductors that are to lie adjacent the cover (the branch conductors 23 in the illustrated embodiment) at a 90° angle to the conductors that lie adjacent the base. Thus, while the conductors 24 and 23 of the bus and branch cables are visually positioned at 90° angles when they are manually pressed into the wire retention areas 31 and 32, the channels 36 and 37 in the base 10 and cover 14 aid to more exactly position the branch conductors 23 at a 90° angle to the bus conductors 24 upon final assembly. With the alignment channels 37 in the cover 24 it may in some cases be desirable to have a pressure sensitive adhesive in the channels 37 and then apply to the cover 14 to the branch cable before the branch cable is pressed onto the contact elements 12.

The base 10 and cover 14 are each formed with two fastening apertures 38 at their diagonally opposite corners and in position to align with the plastic web of the bus cable between conductors 24. Self-threading push-in screws 39 are preferably used to fasten the base 10 and cover 14 together with the bus cable and branch cable between them and each branch conductor 23 electrically connected to a bus conductor 24 in a contact element 12. Self-threading push-in screws are preferred for speed of assembly and also because they can accommodate variations in the thickness of the bus and branch cables. A preferred fastener is sold under the trademark Pushtite by Camcar Division of Textron with offices at Belvidere, Ill.

We claim:

1. A tap connector for tapping branch conductors to conductors of a bus cable, comprising:

an insulating base, a plurality of tap contacts retained in said base, each said contact comprising a flat metal plate having three parallel, closely spaced legs extending from one edge, the two outer legs lying in a common plane and the center leg lying in a plane parallel to said common plane and offset therefrom by a distance at least equal to the thickness of said plate, the outer legs being spaced from the center leg to create two parallel sided conductor connecting slots of lesser width than the conductors to be connected for electrically connecting a branch conductor to a conductor of a bus cable, said contact legs being relieved at their free ends along their edges facing the conductor connecting slots to define wire retention areas of a width greater than the conductors to be connected to engage the insulation on the conductors and the inner edge of one outer leg and the adjacent edge of the center leg of each contact being relieved further along the conductor connecting slot a distance generally equal to the diameter of the insulated conductors to be connected, said contacts being positioned in said insulating base to connect a plurality of parallel, equally spaced conductors of a bus cable to a plurality of parallel equally spaced branch conductors at an angle to the conductors of the bus cable, and an insulating cover having receptacles for the ends of said tap contacts to permit said cover to force the bus and branch conductors into said conductor connecting slots in said contacts when said cover is placed over said base and they are pressed together.

2. The tap connector of claim 1 wherein said base and cover are rectangular and said contacts are positioned with their faces parallel to the longitudinal edges of said base and cover.

3. The tap connector of claim 1 wherein said cover has parallel, equally spaced, wire alignment channels extending across its width at a 45° angle to position the conductors that are to lie adjacent the cover.

4. The tap connector of claim 1 wherein said base has parallel, equally spaced, wire alignment channels extending across its width at a 45° angle to position the conductors that are to lie adjacent the base.

5. The tap connector of claim 1 including a plurality of push-in fasteners for retaining said base and said cover together with connected bus and branch conductors between them.

6. A tap connector for tapping branch conductors to conductors of a bus cable, comprising:

an insulating base, a plurality of tap contacts retained in said base, each said contact comprising a flat metal plate having three parallel, closely spaced legs extending from one edge, the two outer legs lying in a common plane and the center leg lying in a plane parallel to said common plane and offset therefrom by a distance at least equal to the thickness of said plate, the outer legs being spaced from the center leg to create two parallel sided conductor connecting slots of lesser width than the conductors to be connected for electrically connecting a branch conductor to a conductor of a bus cable, said contacts being positioned in said insulating base to connect a plurality of parallel, equally spaced conductors of a bus cable to a plurality of parallel equally spaced branch conductors at a 90° angle to the conductors of the bus cable, and an insulating cover having receptacles for the ends of said tap contacts to permit said cover to force the bus and branch conductors into said conductor connecting slots in said contacts when said cover is placed over said base and they are pressed together, at least one of said base and said cover having parallel, equally spaced, wire alignment channels extending across its width at a 45° angle to position the conductors that are to lie adjacent thereto.

7. The tap connector of claim 6 wherein both said base and said cover are formed with said wire alignment channels.

8. The tap connector of claim 6 wherein said base and cover are rectangular and said contacts are positioned with their faces parallel to the longitudinal edges of said base and cover.

9. The tap connector of claim 6 including a plurality of push-in fasteners for retaining said base and said cover together with connected bus and branch conductors between them.

10. The tap connector of claim 6 wherein said contact legs are relieved at their free ends along their edges facing the conductor connecting slots to define wire retention areas of a width greater than the conductors to be connected to engage the insulation on the conductors.

11. The tap connector of claim 10 wherein the inner edge of one outer leg and the adjacent edge of the center leg of each contact are relieved further along the conductor connecting slot a distance generally equal to the diameter of the insulated conductors to be connected.

* * * * *